US010575655B2

(12) United States Patent
Hjelmeland

(10) Patent No.: US 10,575,655 B2
(45) Date of Patent: Mar. 3, 2020

(54) FOLDABLE CHAIR

(71) Applicant: Sindre Hjelmeland, Sandefjord (NO)

(72) Inventor: Sindre Hjelmeland, Sandefjord (NO)

( * ) Notice: Subject to any disclaimer, the term of this patent is extended or adjusted under 35 U.S.C. 154(b) by 159 days.

(21) Appl. No.: 15/928,824

(22) Filed: Mar. 22, 2018

(65) Prior Publication Data

US 2019/0208921 A1 Jul. 11, 2019

(30) Foreign Application Priority Data

Jan. 10, 2018 (NO) ..... 20180039

(51) Int. Cl.
*A47D 1/02* (2006.01)
*A47C 7/50* (2006.01)
*A47C 4/08* (2006.01)

(52) U.S. Cl.
CPC ..... *A47D 1/023* (2017.05); *A47C 7/50* (2013.01); *A47C 4/08* (2013.01)

(58) Field of Classification Search
CPC ..... A47D 1/023; A47C 7/50
USPC ..... 297/16.2, 30, 55
See application file for complete search history.

(56) References Cited

U.S. PATENT DOCUMENTS 4,046,084 A 9/1977 Hosford et al.
4,359,243 A 11/1982 Crutcher
8,764,105 B2 * 7/2014 Gendell ..... A47C 4/28 297/16.2
2006/0278140 A1 12/2006 Chen
2012/0242114 A1 * 9/2012 Boucquey ..... A47D 1/023 297/30

FOREIGN PATENT DOCUMENTS

| | | | |
|---|---|---|---|
| CN | 201550932 | U | 8/2010 |
| CN | 102204757 | A | 10/2011 |
| CN | 204970351 | U | 1/2016 |
| DE | 08434844.5 | U1 | 2/1985 |
| DE | 3800597 | A1 | 7/1989 |
| DE | 29500023.6 | U1 | 6/1995 |
| DE | 202011103275 | U1 | 2/2012 |
| DE | 202011103769 | U1 | 4/2012 |
| KR | 20-2017-0003569 | U | 10/2017 |

OTHER PUBLICATIONS

Kai Stania, "SUPAflat", Reddot award winner 2014, 4 pages.

* cited by examiner

*Primary Examiner* — Anthony D Barfield
(74) *Attorney, Agent, or Firm* — Birch, Stewart, Kolasch & Birch, LLP

(57) ABSTRACT

A foldable chair includes a main plate and a support plate. The support plate is hinged along a first rim to a rear side, along a central, longitudinal, top-down, axis, of the main plate. The main plate has a seat plate and a foot-rest plate each hinged along an upper edge to the main plate in corresponding apertures of the main plate. The support plate includes bracket portions extending, in the plane of the support plate, from the first rim, in each corresponding position corresponding to the apertures, for pushing the plates up to an operative position and supporting each of the seat plate and the foot-rest plate in an unfolded, operative, position when the plane of the support plate is arranged perpendicular to the plane of the main plate.

20 Claims, 9 Drawing Sheets

FOLDABLE CHAIR

FIELD OF THE INVENTION

The present invention relates to the field of furniture, more specific, foldable chairs and particularly chairs for children.

BACKGROUND ART

A lot of foldable chairs and also a lot of high chairs special designed for small children exist in the market, such as the widely known wooden made "Trip Trap" chair, combined chair and table, assembling type of plastic seats and metal legs, and foldable chairs of different types.

When a child approaches an age when able to sit it is important that the child sits safe and comfortable and with a certain degree of freedom to move without risk of falling out of the chair while seated. It is also a major advantage that such a furniture is easy to put together and away when not in use. Also of a safety view, not to climb the chair when unattended, it is wise to put such a chair away. A fixed high chair for a child is commonly known as space demanding, thus foldable chairs are very practical.

In the field of foldable chairs constituting a flat, collapsed, folded unit when not in use, DE202011103275U1 describes a foldable multifunction furniture with a main use as a chair. The chair is made of mainly one base plate and comprising a foot rest plate and a seat plate to be folded out of the base plate. The surrounding portion of the frame constitutes the fore leg and support brackets for the unfolded seat and footrest plates. A central leg is unfolded from a top portion and constitutes a rear support leg. Seat and foot rest plate are connected to the rear support leg with a hinge system to fold and unfold and have locking bolts to the base plate frame structure to keep the plates and frame locked together in a folded position. When unfolding the seat plate comes out of the space above the seat and leaves a hole in the structure in the position of a seated persons back. This chair could have a use as a children chair, but lacks essential features for safety and comfort, such as back rest and safety hoop.

Another chair in the market is the "SUPAflat" chair. This is also a chair which may be folded and collapsed as a flat unit. This chair has two identical square U-formed leg structures, a seat plate, a backrest plate, a table like safety hoop and a slim foot rest plate. The leg structure, the seat plate, the backrest plate and the safety hoop are all linked and coupled together in a way that, when unfolding the chair, they arrange themselves in correct position for seating. Also, the safety hoop table is connected to, and holding the seat plate with a safety bar in the front and arranged for placing the children's legs on each side, preventing the seated child to fall out of the chair under the safety hoop.

Different foldable, collapsible flat unit chairs are available. Examples are given in DE29500023U1, US20060278140A1, U.S. Pat. No. 4,046,084, CN201550932U, DE8434844U1, U.S. Pat. No. 4,359,243, DE202011103769. They do mainly consist of a plate structure, pivotably and/or rotatably hinged, to form a furniture or a chair when unfolded. Common to those are that they do not form a child chair with a foot rest and a safety hoop and they do not form a satisfactory backrest for a child.

For small apartments, confined living areas, a travelling family, and public areas like restaurants and the like, there are limited space for bulky furniture, especially when the furniture will not be in daily use.

SHORT SUMMARY OF THE INVENTION

A main object of the present invention is to disclose a foldable chair for small children, but also for use by other persons. The invention is a foldable chair comprising a main plate and a support plate, the support plate being hinged along a first rim to a rear side, along a central, longitudinal, top-down, axis, of the main plate, wherein the main plate having a seat plate and a foot-rest plate each hinged along an upper edge to the main plate in corresponding apertures of the main plate, the support plate further comprising bracket portions extending, in the plane of the support plate, from the first rim, in each corresponding position corresponding to the apertures, for pushing the plates up to an operative position and supporting each of the seat plate and the foot-rest plate in an unfolded, operative, position when the plane of the support plate is arranged perpendicular to the plane of the main plate.

By changing different dimensions the chair may be used as a barstool, a cafè-stool or the like.

The chair may easily be unfolded and locked into an operative position by use of one hand grip and pushed open by the foot.

FIGURE CAPTIONS

The attached figures illustrate some embodiments of the claimed invention.

FIG. 1 left is a rear view of an embodiment of the chair in an unfolded position.

FIG. 1 right is a side view of the chair in a folded position.

Figure 11:
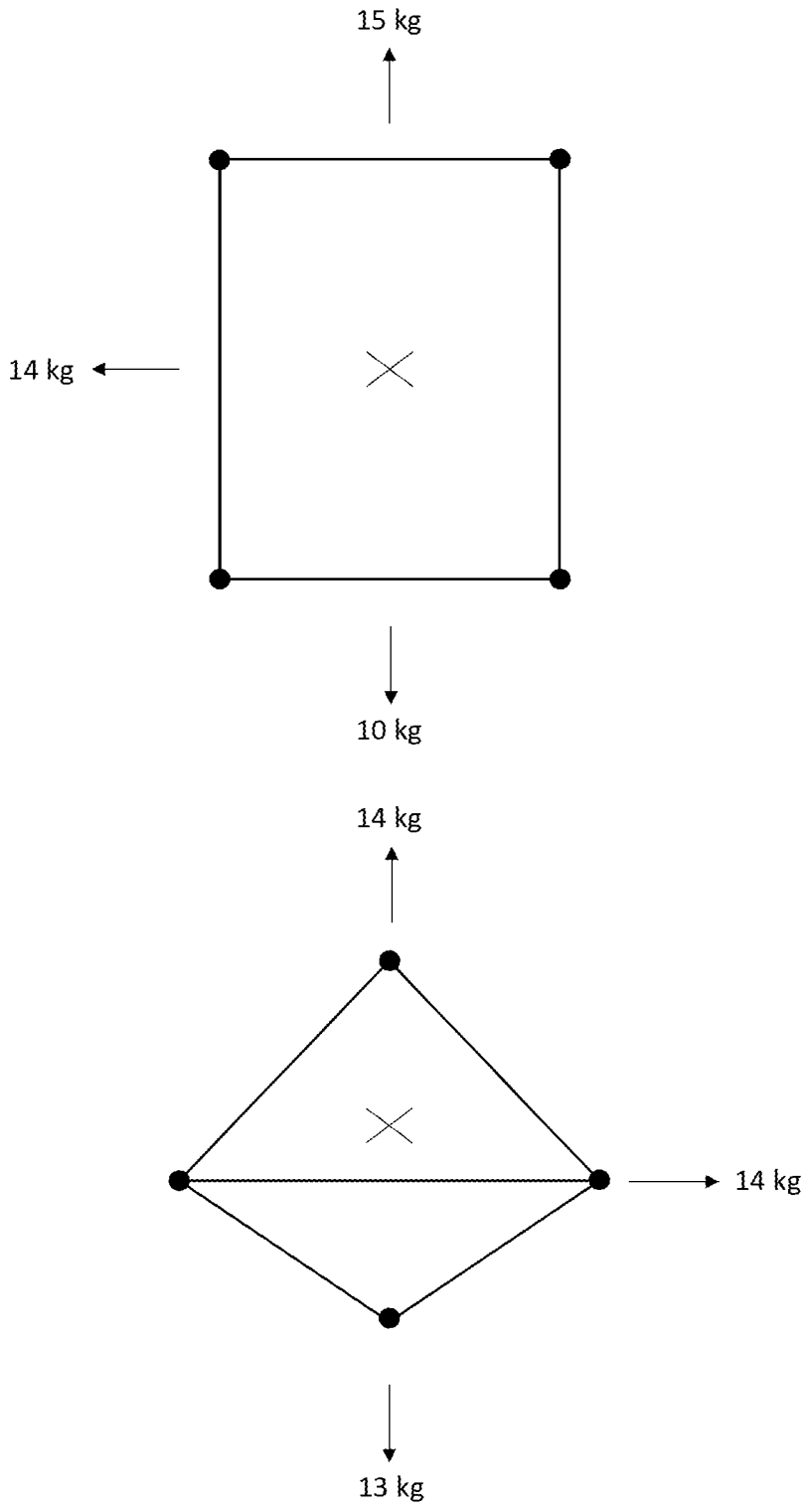

FIG. 11 is a simple test result illustration of a stability test of the chair according to an embodiment of the invention (bottom illustration) compared to a dining chair (top illustration). The embodiment of the children chair may take an added load of 13 kg in front and 14 kg on rear side before tilting. In comparison the tested dining chair may take 10 kg in a front position and 15 kg in a rear load. Stability may be improved by changing width, height and material of typically the plates A and E.

EMBODIMENTS OF THE INVENTION

The invention will in the following be described and embodiments of the invention will be explained with reference to the accompanying drawings.

Figure 3:
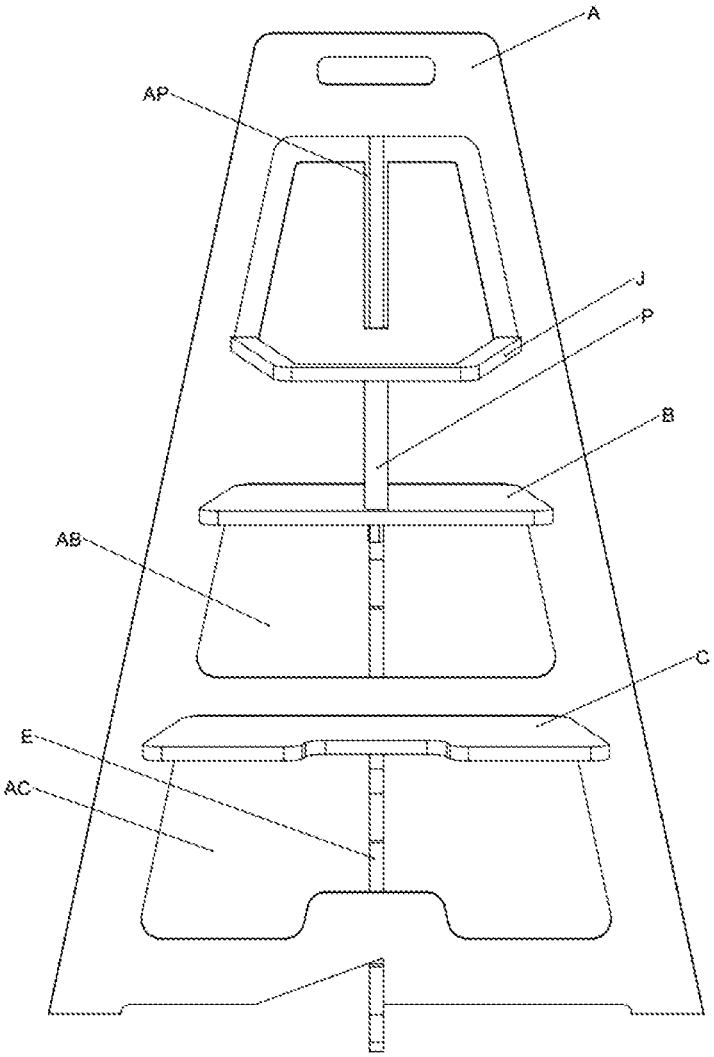
FIG. 3 shows an embodiment of the chair in a front view and an unfolded position.
Figure 4:
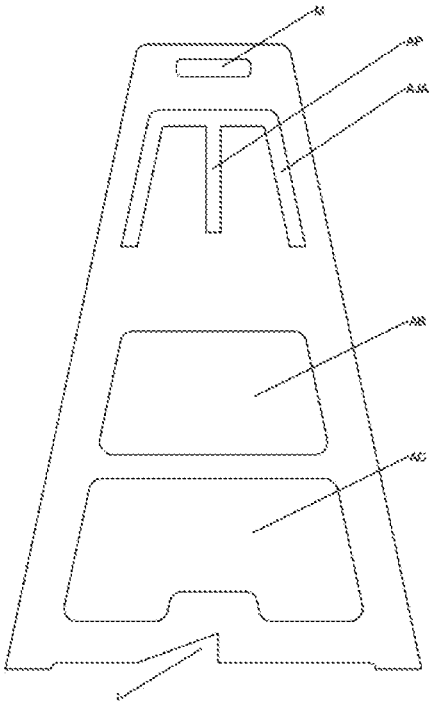
FIG. 4 shows an embodiment of the main plate (A) designed for a safety hoop to be accommodated in a cut out in the main plate.
Figure 5:
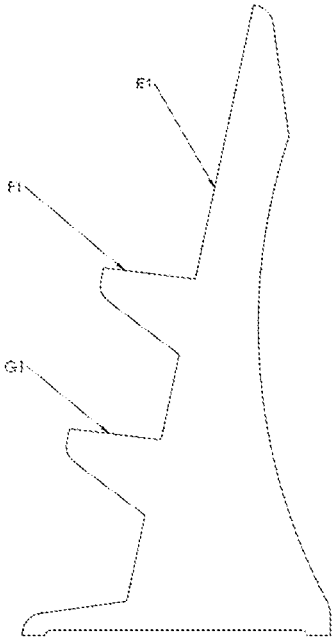
FIG. 5 shows an embodiment of the support plate (E). This plate will be similar for embodiments with or without the integrated safety hoop.
Figure 6:
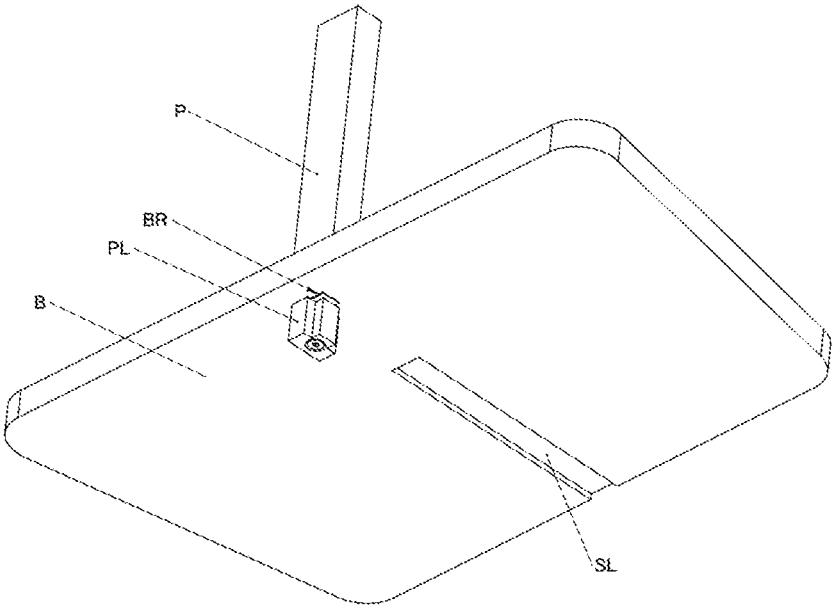
FIG. 6 shows a detail of an embodiment of the seat plate (B) from underneath. A recess for locking the bracket portion (F) into an operating position is shown as well as the locking portion (PL) for the support leg (P) in a locked position through the seat plate (B).
Figure 7:
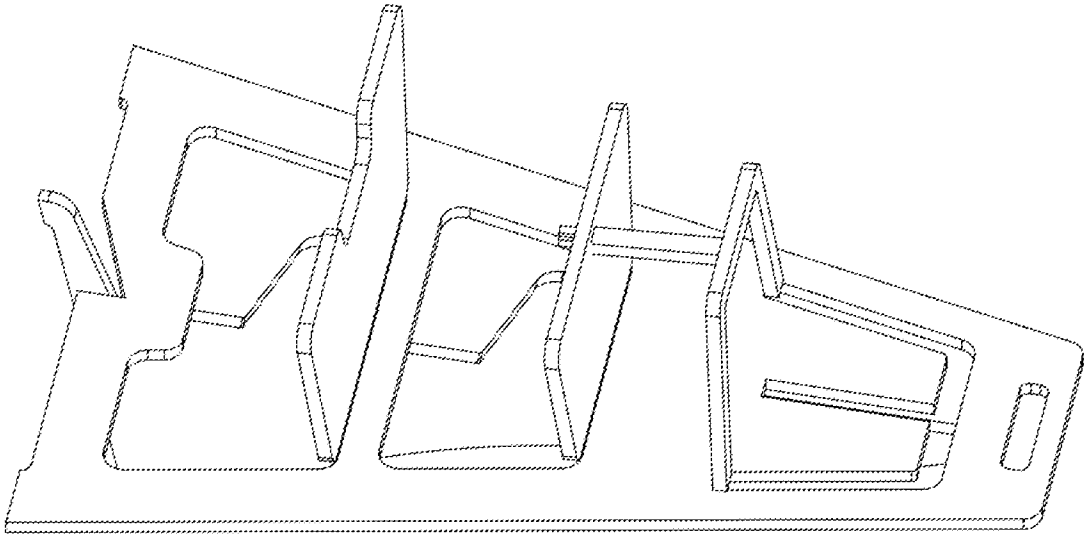
FIG. 7 shows an embodiment of the chair in a front perspective view and in an operative position.
Figure 8:
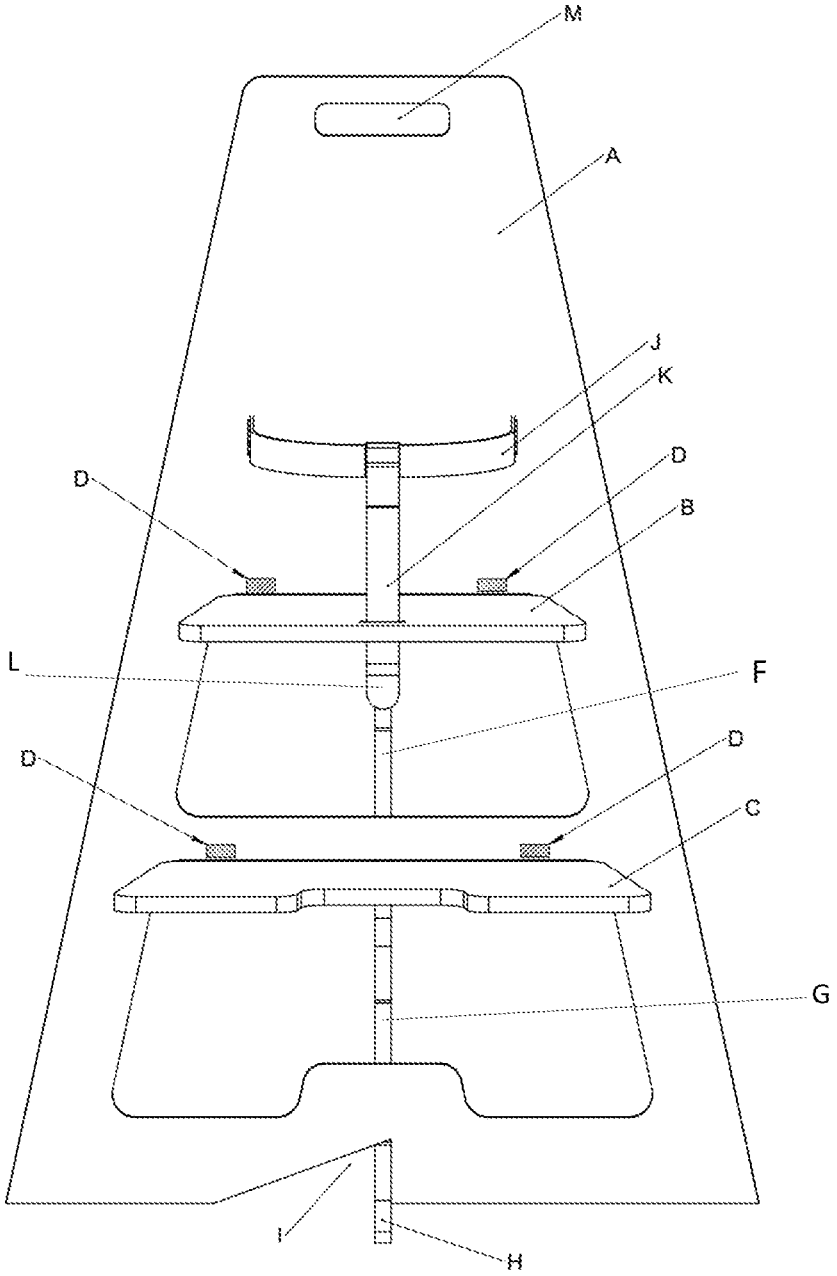
FIG. 8 is a front view of an embodiment of the invention wherein the safety hoop is not an integrated portion but an additional hoop for hooking onto the main plate (A).

The invention is a foldable chair (1) comprising a main plate (A) and a support plate (E), the support plate (E), hinged, by hinges (N) along a first rim (E1) to a rear side (AR), along a central, longitudinal, top-down, axis (0), of the main plate (A), for forming a support structure for the chair in an unfolded upright operative position, and wherein the main plate having a seat plate (B) and a foot-rest plate (C) each hinged along an upper edge, by hinges (D), to the main plate (A) in corresponding apertures (AB, AC) of the main plate (A), the support plate (E) further comprising bracket portions (F, G) extending, in the plane of the support plate (E), from the first rim (A1), in each corresponding position corresponding to the apertures (AB, AC), for pushing the plates (B, C) up to an operative position and supporting each of the seat plate (B) and the foot-rest plate (C) when unfolded, in an operative, position when the plane of the support plate (E) is arranged perpendicular to the plane of the main plate (A), please see FIG. 3 and FIG. 7.

A main object of the present invention is to disclose a foldable chair for small children, but also for use by other persons. By changing dimensions, the chair may be used as a barstool, a café-stool or the like.

Figure 1:
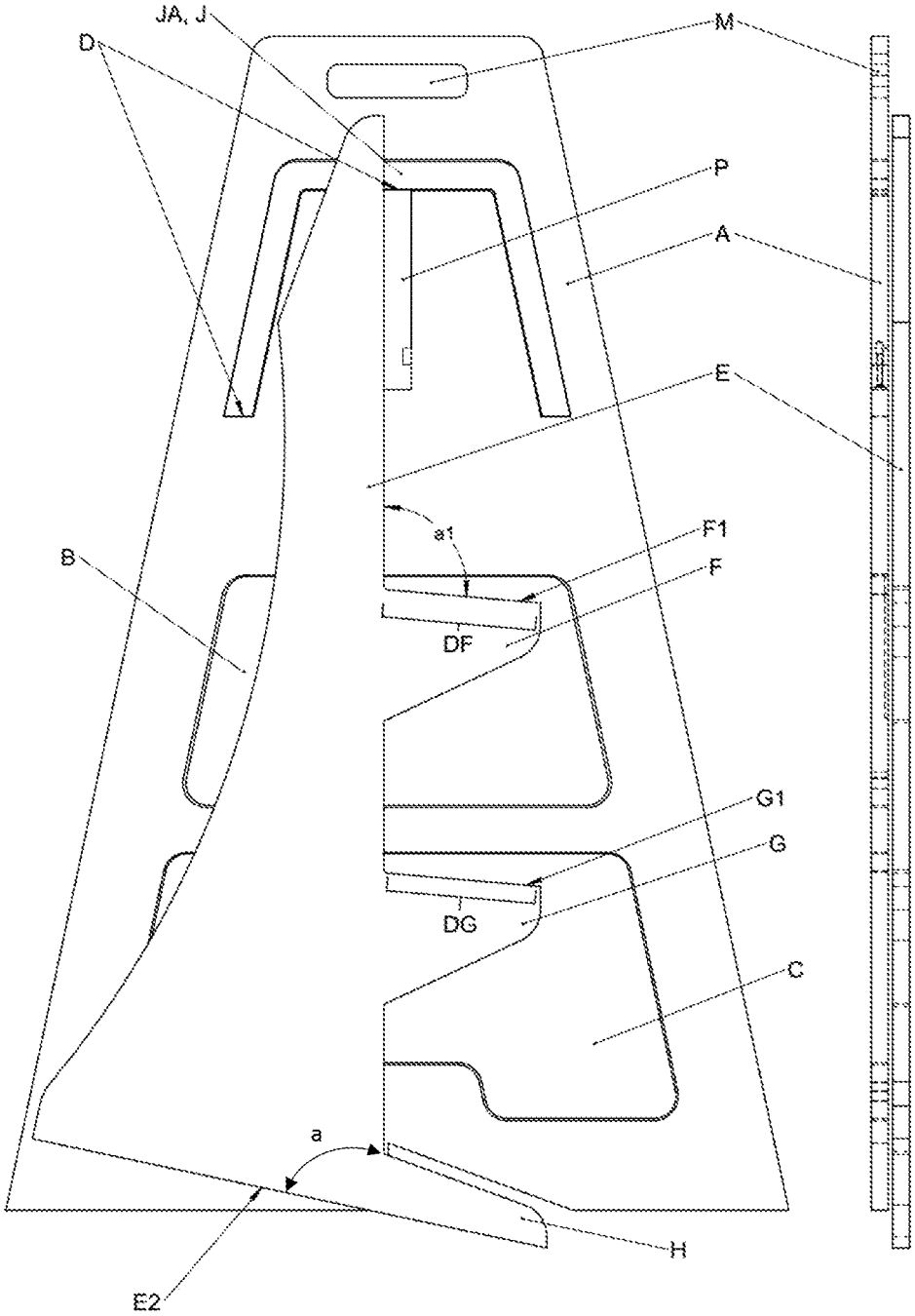
Figure 2:
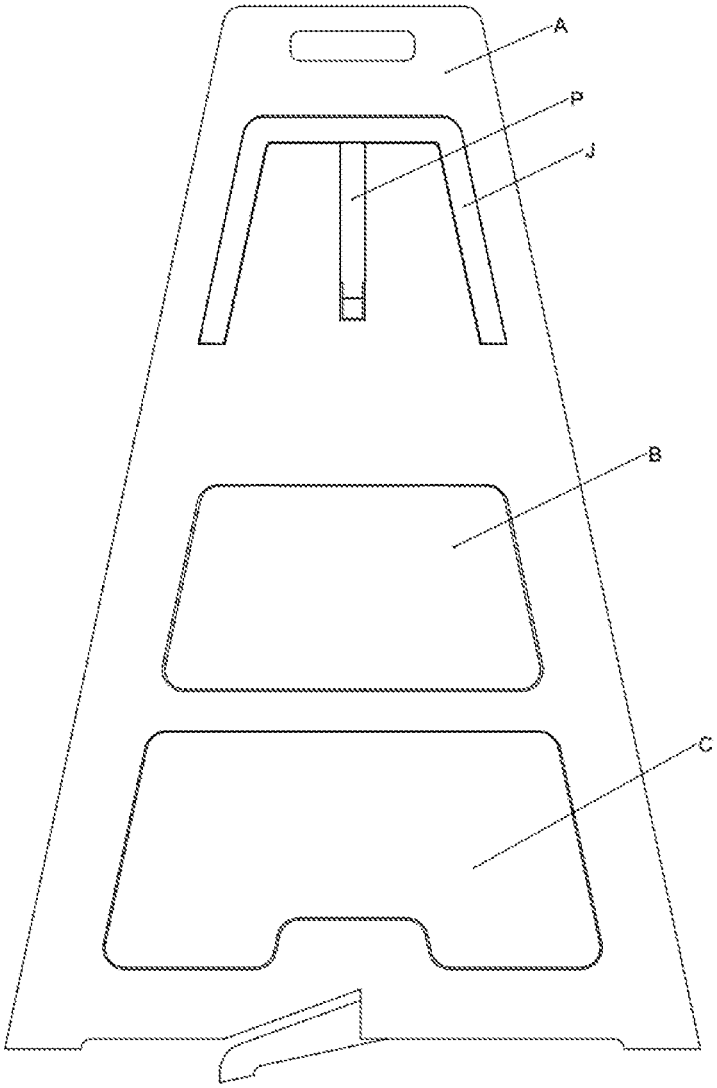
FIG. 2 shows an embodiment of the invention in a front view and in a folded position.
Figure 9:
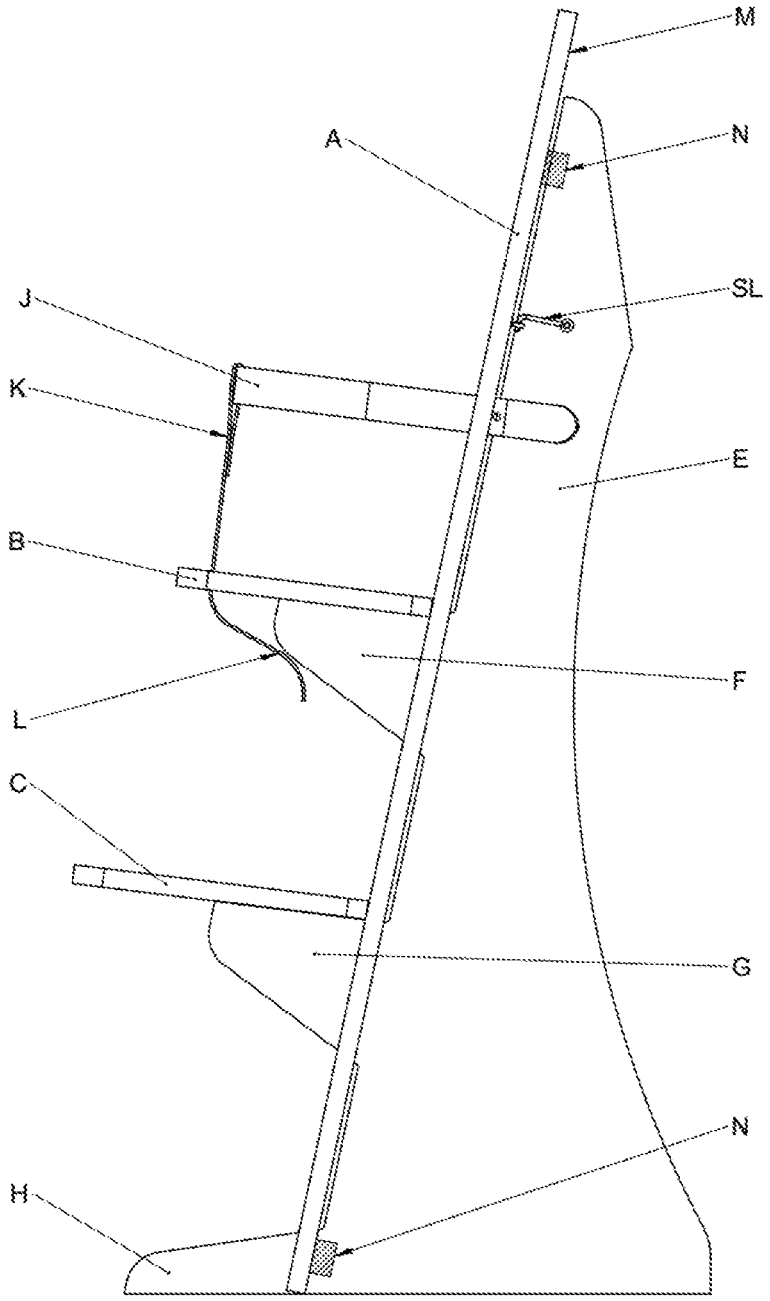
FIG. 9 is a side view of the embodiment shown in FIG. 8.

As seen from FIGS. 1, 7 and 9, when turning the support plate (E) 90° relative to the main plate (A) the bracket portions (F, G) will engage to the seat plate (B) and the foot rest plate (C) and push them up and into a seating position.

This furniture may then be collapsed, folded and easily put away for storage or bring along in a car or sent by post in a flat package, see FIG. 1, right illustration.

In an embodiment of the invention the foldable chair, the bottom rim (E2) of the support plate (E) and the main plate (A) plane forming an angle (a) between 90° and 60° in an unfolded position. This gives the chair a slight reclined design which gives a comfortable seating position and makes a safe support structure.

The foldable chair according to an embodiment of the invention has bracket portions (F,G) each having an upper supporting rim (F1, G1), each of the support rims (F1, G1) extending from the first rim (E1) with an angle (a1) above 90°. This forming a comfortable seat and making an easy open push function due to its low attack point to the plates, decreasing the force needed to lift the respective plates (B, C), and providing an easy to handle design.

In an embodiment the foldable chair according to the invention the angle (a) is 75°. This is tested as a safe and comfortable chair.

In an embodiment of the invention the main plate (A) comprises a central arranged recess (I) in a bottom rim (A2) of the main plate (A) and the support plate (E) comprises a support bracket portion (H) extending, in the plane of the support plate (E), from the first rim (E1), as an extension of the bottom rim (E2) and corresponding to the recess (I), the support bracket portion (H) thus forming a support leg extending out in a front position of the chair (1). This is a preferred feature if the chair is designed as a chair for small children as this will prevent a forward tilting movement of the chair (1), especially important when the child moves in the chair. If the invention is manufactured for use as a barstool or the like this feature is not that essential.

In an embodiment of the invention a top portion (T) of the main plate (A) extends above the seat plate (B) forming a backrest for a user of the chair (1). The design of having the seat and foot rest plate hinged in an upper position so as to be lifted from a lower position, leaving the empty space, the aperture (AB, AC) below the corresponding plates (A,B) provides for a back rest space above the seat plate which is an essential feature for a chair for a small child. Again, if the furniture is designed as a barstool or another type of chair this is not such an essential feature. Nevertheless a backrest is improving the comfort of the chair.

Figure 10:
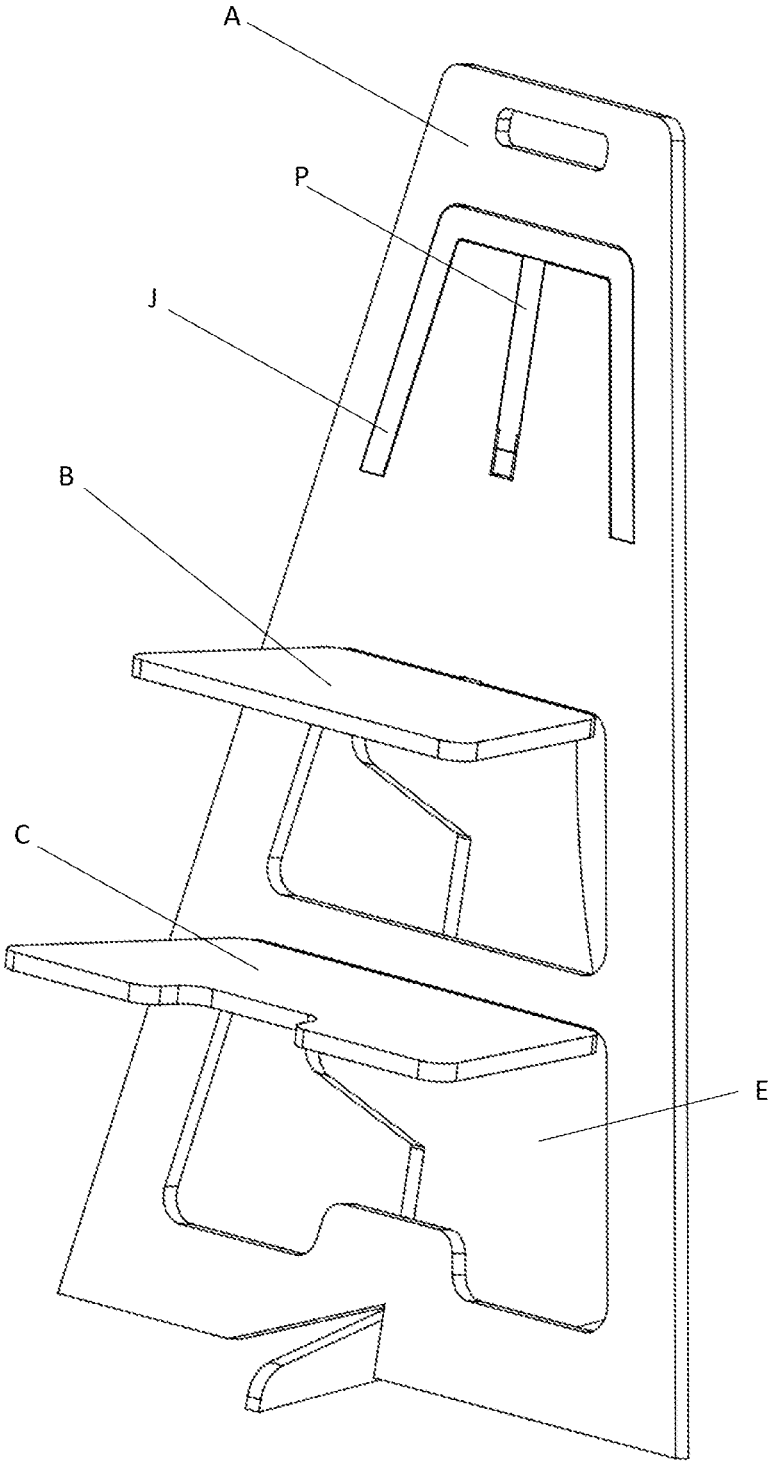
FIG. 10 is an illustration of an embodiment in an alternative operative position without the safety hoop unfolded.

For a chair for small children, the foldable chair according to an embodiment of the invention, the top portion (T) comprising a safety hoop mean (J). This may be a soft material, releasably attached, at a waist height of a seated child. In an embodiment such a safety hoop mean (J) comprising an arch hoop (JA) and a support leg (P), accommodated in corresponding apertures (AJA, AP) on the main plate (A), in a folded position. The arch hoop (JA) is hinged in end portions of the arch hoop (JA) to the main plate in both lowermost portions of the aperture (AJA), at a waist height of a small child, and the support leg (P) is hinged to the arch hoop (AJA), for being unfolded to a safety hoop. The arch hoop and the support leg may also be cut out of the main plate (A). To use the safety hoop this is folded out and downwards together with the support leg arranged in the middle of the arch and to further pivot to extend between the arch hoop (JA) and the seat plate (B). The safety hoop means (J) is separately operated, which improves the range of use of the chair. Larger kids or grown ups may use the chair without folding down the safety hoop mean (J). The chair may also serve as a step ladder or a barstool when the safety hoop means (J) is not unfolded as illustrated in FIG. 10.

In an embodiment of the invention having a support leg in the safety hoop mean, the support leg (P) comprises a lock portion in an opposite end of the hinged end, for interconnection with an elongated recess (BR) in the seat plate (B), at least the lock portion being rotatable, thus forming a rotation lock (PL) when arranged through the recess and rotated. In an embodiment a rotatable hinge (DR) may be arranged between the arch hoop (JA) and the support leg (P) for rotating the whole support leg then the support leg further having at least one recess (PR) for interconnection with the elongated recess (BR) in the seat plate (B), thus forming a rotation lock (PL). In an embodiment only the lock portion being rotatable arranged in the opposite end of the hinged end and may be separately rotated for locking the support leg (P) to the seat plate (B).

The foldable chair may also comprise a security lock (SL), locking the chair in an unfolded, operative, position. Such a security lock (SL) may in an embodiment be a recess running along a central line of a bottom side of the seat plate (B) for accommodate the support rim (F1) of the support bracket (F) when the chair is unfolded to a seating position. This may also be supplemented by a similar recess in the foot plate, if the child rises in the chair with the feet on the foot plate (C) the recess type lock in the seat plate may not be active but the one in the foot plate will. A vertical end rim in the recess (I) at a central position of the main plate (A) will in an embodiment of the chair limit the support plate (E) to be unfolded more than 90° relative to the main plate (A). An alternative or additional security lock may also be a hook lock at the rear side of main plate connected to support plate (E).

The foldable chair may in any embodiments comprise a hole (M) in an uppermost section of the main plate (A) constituting a gripper and suspension hole (M). A proper grip in the chair by one hand may allow a person to unfold the chair to a seating position only by push or pull the support plate (E) by e.g. the foot. This allows the person for instance to hold the child to be seated by the other arm. Also, the hole (M) may serve as a suspension hole for putting the chair away when not in use. For example, on a joint stand in a restaurant, a kindergarten etc., having more such chairs at a wall, inside a closet, or the like, in a family home.

In an embodiment of the invention the foot plate has a central front recess for the chair to be placed closer to a table outside a table leg.

The chair according to the invention is mainly cut out from a base plate and material loss during production will be low.

This is achieved by cutting out the seat plate, the foot rest plate and the safety hoop with its lock portion of a base plate, wherein the rest of the base plate, the surrounding frame portion constitutes the front leg and backrest portion. As this has an "A-shape" the support plate, constituting the rear leg may be cut out of the "V-portion" left in the rectangular base plate. The base plate may be a wooden plate or another suitable material. In another embodiment the chair may be casted in separate molds and assembled in the similar flat collapsible way as if it was made of one cut out plate.

A major advantage of the invention is that all parts of the chair, the support plate, the extended fore support leg, the main plate, seat plate, foot rest plate and safety hoop may be designed as cut outs of, and parts of, only two main plates. Together they form all necessary elements of a chair for small children. It is easy to open to an operative position and easy to fold and put away for transport or storing. When the child grows older it may be used without the safety hoop and no parts should be stored separately, just fold the safety hoop in to a non operative position and the chair may be used by the older child.

The invention claimed is:

1. A foldable chair comprising:

a main plate; and a support plate, wherein said support plate is hinged along a first rim to a rear side, along a central, longitudinal, top-down, axis, of said main plate, wherein said main plate has a seat plate and a foot-rest plate each hinged along an upper edge to said main plate in corresponding apertures of said main plate, and wherein said support plate further comprises bracket portions extending, in the plane of said support plate, from said first rim, in each corresponding position corresponding to said apertures, for pushing said plates up to an operative position and supporting each of said seat plate and said foot-rest plate in an unfolded, operative, position when the plane of said support plate is arranged perpendicular to the plane of said main plate.

2. The foldable chair according to claim 1, wherein a bottom rim of said support plate and said main plate plane form an angle between 90 and 60° in an unfolded position.

3. The foldable chair according to claim 2, wherein the angle is 75°.

4. The foldable chair according to claim 3, wherein:

said main plate comprises a central arranged recess in a bottom rim of said main plate, and said support plate comprises a support bracket portion extending, in said plane of said support plate, from said first rim, as an extension of said bottom rim and corresponding to said recess, said support bracket portion thus forming a support leg extending out in a front position of said chair.

5. The foldable chair according to claim 3, wherein a top portion of said main plate extends above said seat plate to form a backrest for a user of said chair.

6. The foldable chair according to claim 2, wherein said bracket portions each have an upper supporting rim, each of said support rims extending from said first rim with an angle above 90°.

7. The foldable chair according to claim 2, wherein:

said main plate comprises a central arranged recess in a bottom rim of said main plate, and said support plate comprises a support bracket portion extending, in said plane of said support plate, from said first rim, as an extension of said bottom rim and corresponding to said recess, said support bracket portion thus forming a support leg extending out in a front position of said chair.

8. The foldable chair according to claim 2, wherein a top portion of said main plate extends above said seat plate to form a backrest for a user of said chair.

9. The foldable chair according to claim 1, wherein said bracket portions each have an upper supporting rim, each of said support rims extending from said first rim with an angle above 90°.

10. The foldable chair according to claim 9, wherein:

said main plate comprises a central arranged recess in a bottom rim of said main plate, and said support plate comprises a support bracket portion extending, in said plane of said support plate, from said first rim, as an extension of said bottom rim and corresponding to said recess, said support bracket portion thus forming a support leg extending out in a front position of said chair.

11. The foldable chair according to claim 9, wherein a top portion of said main plate extends above said seat plate to form a backrest for a user of said chair.

12. The foldable chair according to claim 1, wherein:

said main plate comprises a central arranged recess in a bottom rim of said main plate, and said support plate comprises a support bracket portion extending, in said plane of said support plate, from said first rim, as an extension of said bottom rim and corresponding to said recess, said support bracket portion thus forming a support leg extending out in a front position of said chair.

13. The foldable chair according to claim 12, wherein a top portion of said main plate extends above said seat plate to form a backrest for a user of said chair.

14. The foldable chair according to claim 1, wherein a top portion of said main extends above said seat plate to form a backrest for a user of said chair.

15. The foldable chair according to claim 14, said top portion comprising a safety hoop.

16. The foldable chair according to claim 15, said safety hoop mean comprising an arch hoop and a support leg, said safety hoop accommodated in corresponding apertures on said main plate, in a folded position, said arch hoop hinged in end portions of said arch hoop to said main plate in both lowermost portions of said aperture, said support leg hinged to said arch hoop, for being unfolded to a safety hoop.

17. The foldable chair according to claim 16, said support leg comprising a lock portion, in an opposite end of said hinged end, for interconnection with an elongated recess in said seat plate, at least said lock portion being rotatable thus forming a rotation lock when arranged through said recess and rotated.

18. The foldable chair according to claim 1, comprising a security lock, locking in an unfolded position.

19. The foldable chair according to claim 18, said security lock being a recess running along in a central line of a bottom side of said seat plate for accommodating said support rim of said support bracket.

20. The foldable chair according to claim 1, comprising a hole in an uppermost section of said main plate constituting a gripper and suspension hole.

* * * * *